United States Patent [19]

Wright

[11] Patent Number: 4,629,934

[45] Date of Patent: Dec. 16, 1986

[54] MULTIBEAM ELECTRON GUN HAVING MEANS FOR POSITIONING A SCREEN GRID ELECTRODE

[75] Inventor: Andrew K. Wright, Manor Township, Lancaster County, Pa.

[73] Assignee: RCA Corporation, Princeton, N.J.

[21] Appl. No.: 769,978

[22] Filed: Aug. 27, 1985

[51] Int. Cl.[4] ..... H01J 29/50; H01J 29/82

[52] U.S. Cl. ..... 313/417; 313/447; 313/451; 313/456

[58] Field of Search ..... 313/417, 448, 456, 457, 313/451, 447, 414, 446

[56] References Cited

U.S. PATENT DOCUMENTS

| | | | |
|---|---|---|---|
| 4,298,818 | 11/1981 | McCandless | 313/417 |
| 4,500,808 | 2/1985 | McCandless | 313/409 |
| 4,520,292 | 5/1985 | van Hekken et al. | 313/412 |
| 4,558,254 | 12/1985 | Opresko | 313/446 |

OTHER PUBLICATIONS

U.S. patent application Ser. No. 643,175, entitled, "Multibeam Electron Gun Having a Cathode-Grid Subassembly and Method of Assembling Same", filed on Aug. 22, 1984, by McCandless et al. (RCA 80,211).

U.S. patent application Ser. No. 643,314, entitled, "Structure For and Method of Aligning Beam-Defining Apertures by Means of Alignment Apertures", filed on Aug. 22, 1984, by S. T. Villanyi (RCA 80,130).

U.S. patent application Ser. No. 735,261, entitled, "Multibeam Electron Gun Having a Transition Member and Method for Assembling the Electron Gun", filed on May 17, 1985, by H. E. McCandless (RCA 81,197).

"Multibeam Electron Gun Having Means for Positioning a Screen Grid Electrode Relative to a Main Focusing Lens", (RCA 82,000), filed concurrently herewith by S. T. Opresko; U.S. patent application Ser. No. 769,970.

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

The novel electron gun comprises, as in prior guns, a plurality of cathode assemblies and at least two spaced successive electrodes having aligned apertures therethrough for passage of a plurality of electron beams. The cathode assemblies and the electrodes are individually held in position from a common ceramic member. The ceramic member has a first major surface and an oppositely disposed second major surface with a metallized pattern formed on at least a portion of each major surface. The electrodes are attached to the first major surface, and the cathode assemblies are attached to the second major surface. A transition member is attached to the metallized pattern on the first major surface. The transition member includes a substantially flat first part and a second part electrically isolated from the first part. The second part has a flat portion attached to the metallized pattern on the first surface and two upright portions substantially perpendicular to the flat portion and substantially parallel to each other. One of the electrodes is attached to the first part of the transition member. A plurality of support members are disposed between the other electrode and the upright portions of the second part of the transition member, whereby the other electrode can be positioned laterally and longitudinally with respect to the one electrode and secured in alignment therewith.

3 Claims, 4 Drawing Figures

MULTIBEAM ELECTRON GUN HAVING MEANS FOR POSITIONING A SCREEN GRID ELECTRODE

BACKGROUND OF THE INVENTION

The present invention relates to an improved multibeam electron gun and particularly to an electron gun in which a screen grid (G2) electrode is individually attached to a common ceramic member and positioned relative to a control grid (G1) electrode.

U.S. Pat. No. 4,298,818 issued to McCandless on Nov. 3, 1981 discloses an electron gun having a plurality of cathode assemblies and at least two spaced, successive electrodes having aligned apertures which are individually attached directly to a metallized pattern on a common ceramic member. Longitudinal spacing between the successive electrodes is provided by the accurately dimensioned parallel flanges on each of the electrodes and by the flatness of the surface of the ceramic member to which the electrodes are attached. Variations in surface flatness of the ceramic member or in the flange heights of the electrodes will cause corresponding variations in spacing between the successive electrodes. Proper operation of a multibeam cathode-ray tube utilizing such an electron gun requires that the spacing and alignment between successive electrodes in the electron gun be accurately maintained. Apertures that are misaligned by as little as 0.127 mm (0.5 mils) can cause distorted beam shapes and degrade the performance of the tube.

U.S. Pat. No. 4,500,808, issued to McCandless on Feb. 19, 1985, describes an improved electron gun similar to that of U.S. Pat. No. 4,298,818 except that the second electrode comprises a composite structure having a metal support plate brazed directly to a metallized pattern on one surface of a certamic support. The metal support plate has a window therein opposite each of the apertures in a first electrode which is also brazed directly to a separate metallized pattern on the same surface of the ceramic support. Separate metal plates are brazed to the metal support plate and close the windows therein. Each of the metal plates has a single electron beam-defining aperture therein which is separately aligned with one of the apertures in the first electrode. This structure provides more accurate alignment of successive grid apertures than previous structures; however, the longitudinal spacing between the successive electrode also depends upon the flatness of the surface of the ceramic member and the flange heights of the first electrode and of the metal support plate of the second electrode.

SUMMARY OF THE INVENTION

The novel electron gun comprises, as in prior guns, a plurality of cathode assemblies and at least two spaced, successive electrodes having aligned apertures therethrough for passage of a plurality of electron beams. The cathode assemblies and the electrodes are individually held in position from a common ceramic member. The ceramic member has a first major surface and an oppositely disposed second major surface with a metallized pattern formed on at least a portion of each major surface. The electrodes are attached to the first major surface, and the cathode assemblies are attached to the second major surface. A transition member is disposed on the first major surface of the ceramic member. The transition member includes a substantially flat first part and a second part electrically isolated from the first part. The second part has a flat portion attached to the metallized pattern and two upright portions substantially perpendicular to the flat portion and substantially parallel to each other. One of the electrodes is attached to the first part of the transition member. A plurality of support members are disposed between the other electrode and the upright portions of the second part of the transition member, whereby the other electrode can be positioned laterally and longitudinally with respect to the one electrode and secured in alignment therewith.

DETAILED DESCRIPTION OF THE PREFERRED EMBODIMENT

Figure 1:
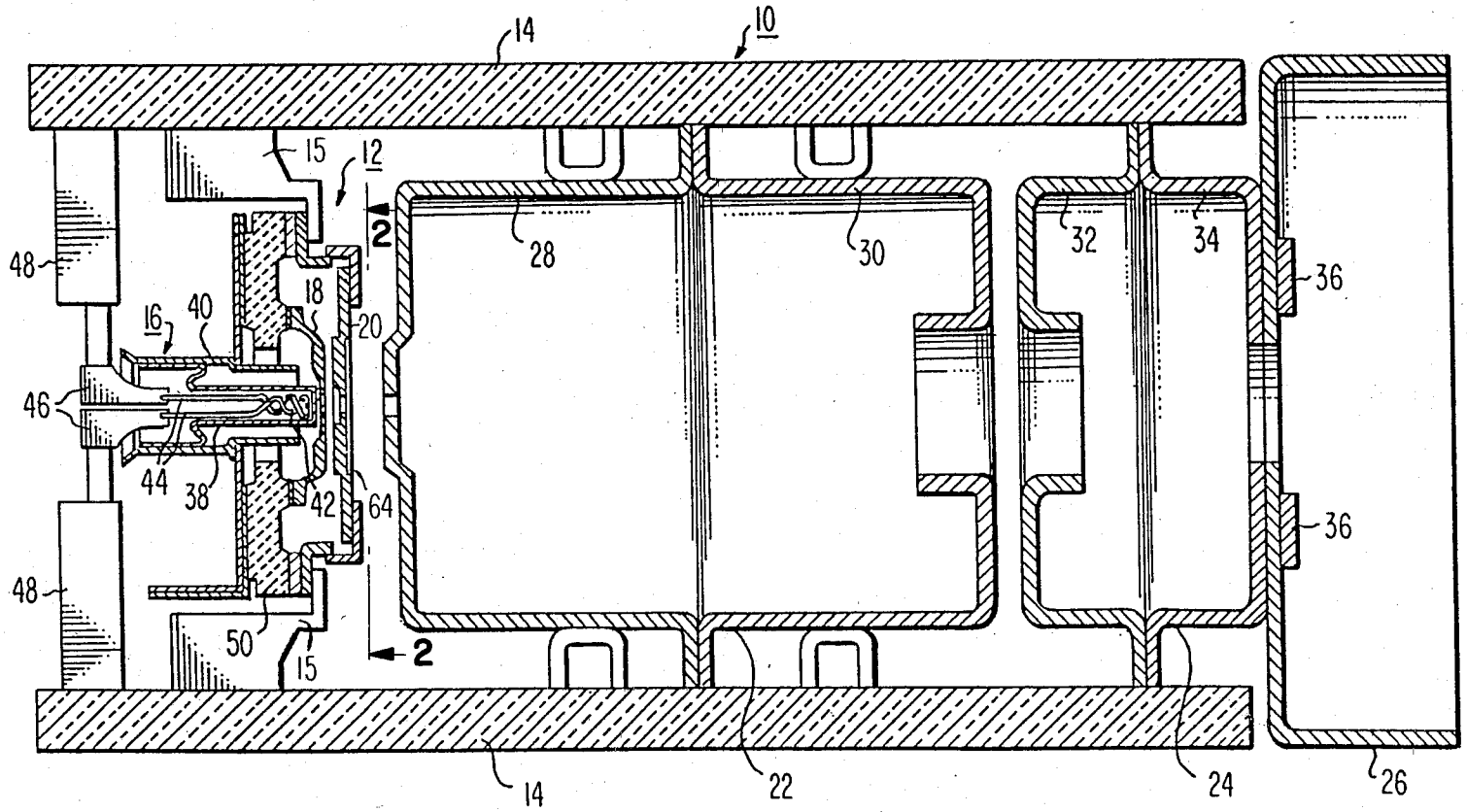
FIG. 1 is a partially cut-away, side elevational view of a preferred embodiment of the novel electron gun.

As shown in FIG. 1, an improved electron gun 10 includes a modular beam-forming region, BFR, assembly 12 secured to a pair of glass support rods 14, also called beads, by a plurality of metal bead support members 15. The modular BFR assembly 12 includes three equally spaced inline cathode assemblies 16, one for each electron beam (only one of which is shown in the view of FIG. 1), a control grid electrode 18 and a screen grid electrode 20. Longitudinally spaced from the BFR assembly 12 is a main electron lens comprising a first focusing electrode 22 and a second focusing electrode 24. A shield cup 26 is affixed to the second focusing electrode 24.

The first focusing electrode 22 comprises a substantially rectangular cup-shaped lower first member 28 and a similarly shaped upper first member 30 joined together at their open ends. The closed ends of the members 28 and 30 have three apertures therethrough, although only the center apertures are shown in FIG. 1. The apertures in the first focusing electrode 22 are aligned with the apertures in the control and screen grid electrodes 18 and 20. The second focusing electrode 24 also comprises two rectangularly cup-shaped members, including a lower second member 32 and an upper second member 34 joined together at their open ends. Three inline apertures also are formed in the closed ends of the upper and lower second members 32 and 34, respectively. The center apertures in the upper and lower second members 32 and 34 are aligned with the center apertures in the other electrodes; however, the two outer apertures (not shown) in the second focusing electrode 24 are slightly offset outwardly with respect to the two outer apertures in the first focusing electrode 22 to aid in convergence of the outer beams with the center beam. The shield cup 26, located at the output end of the gun 10, has appropriate coma correction members 36 located on its base around or near the electron beam paths, as is known in the art. The first and second focusing electrodes 22 and 24, respectively, are affixed to the support rods 14.

Each of the cathode assemblies 16 comprises a substantially cylindrical cathode sleeve 38 closed at the forward end and having an electron emissive coating (not shown) thereon. The cathode sleeve 38 is supported at its open end within a cathode eyelet 40. A heater coil 42 is positioned within the sleeve 38 in order to indirectly heat the electron emissive coating. The heater coil 42 has a pair of legs 44 which are welded to heater straps 46 which, in turn, are welded to support studs 48 that are embedded in the glass support rods 14.

Figure 2:
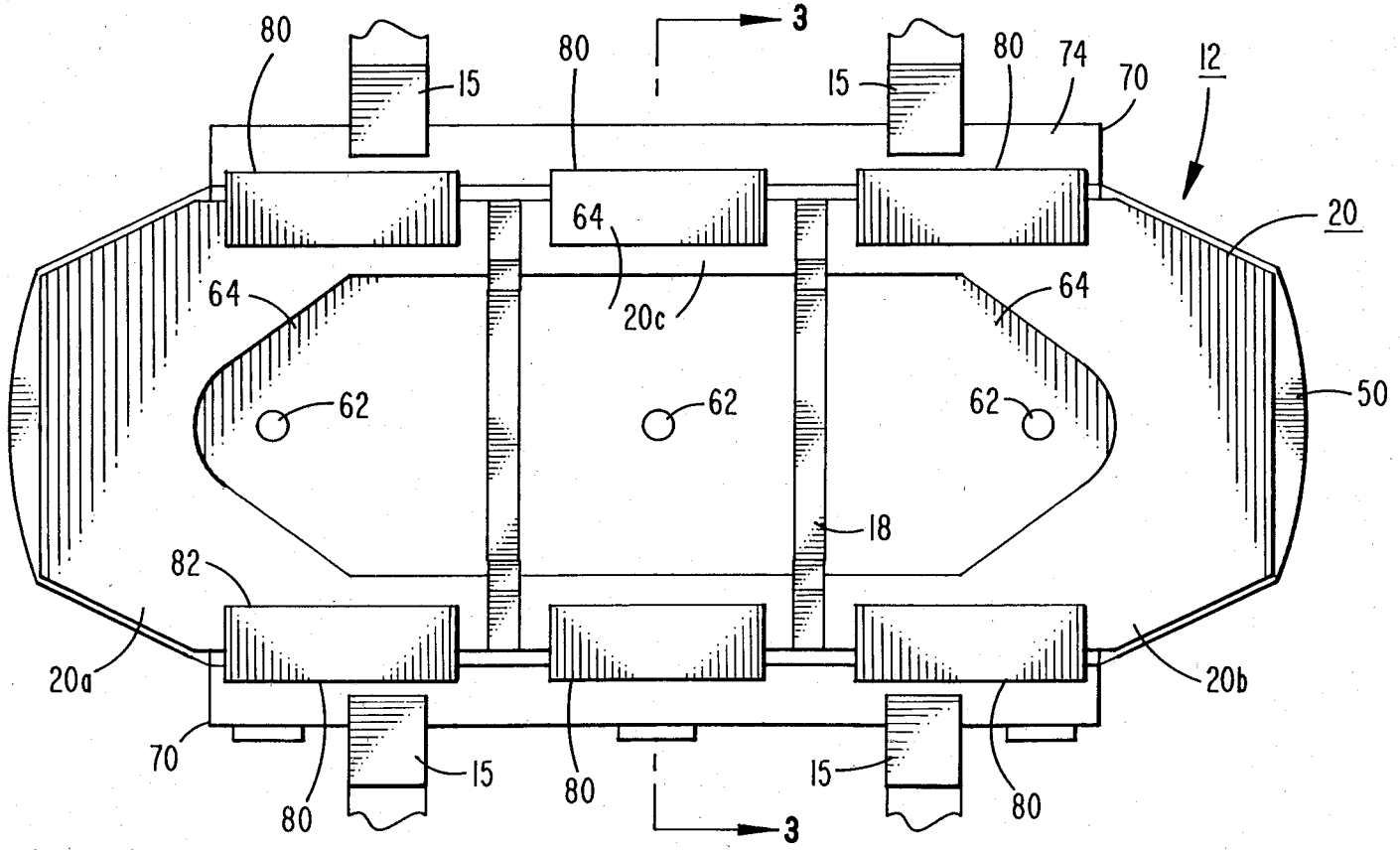
FIG. 2 is an enlarged plan view of a portion of the electron gun taken along line 2—2 of FIG. 1.
Figure 3:
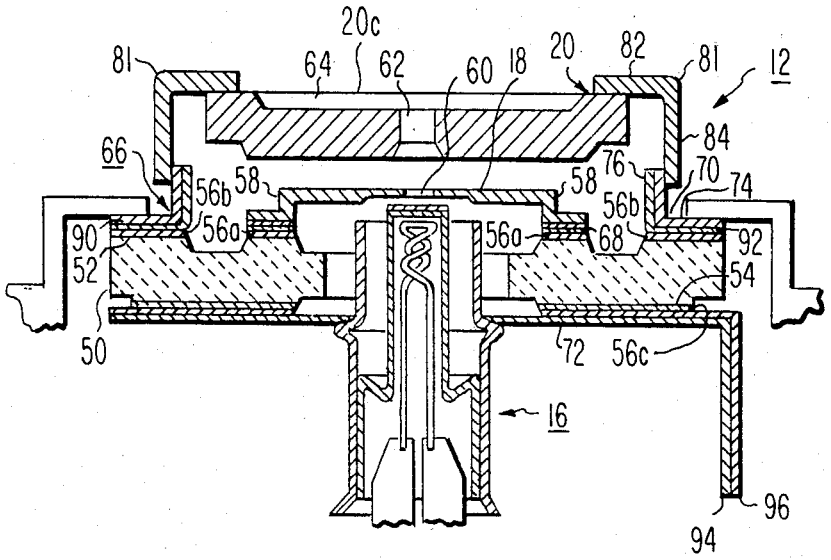
FIG. 3 is a sectional view taken along line 3—3 of FIG. 2.

The modular BFR assembly 12, shown in FIGS. 2 and 3, includes a ceramic member 50, having an alumina content of about 99%, to which the cathode assemblies 16 and the control grid and screen grid electrodes 18 and 20 are attached. The ceramic member 50 includes a first major surface 52 and an oppositely disposed substantially parallel second major surface 54. The ceramic member has a thickness of about 1.5 mm (0.060 inch). At least a portion of the first major surface 52 has metallizing patterns **56*a* and 56*b* formed thereon to permit attachment thereto of the electrodes 18 and 20, respectively. The metallized patterns 56*a* and 56*b* comprise discrete areas that are electrically isolated from each other. A plurality of electrically isolated metallizing patterns (only one of which, 56*c*, is shown) are provided on the second major surface 54 to permit attachment of the cathode assemblies 16 thereto. The metallizing of a ceramic member is well known in the art and needs no further explanation. The major surfaces 52 and 54 may include lands, as shown in FIG. 3, which facilitate application of the electrically isolated metallizing patterns thereto. The control grid electrode 18 is essentially a flat plate having two parallel flanges 58 on opposite sides of three inline, precisely spaced, beam-defining apertures 60, only one of which is shown. The screen grid electrode 20 preferably comprises three separate plate-like portions each of which have a beam-defining aperture 62 therethrough. The outer portions are designated 20*a* and 20*b* and the center portion is designated 20*c*. A recess 64 is formed in the surface of the screen grid electrode 20 that is adjacent to the lower first member 28 of the first focusing electrode 22, as shown in FIG. 1. The recess 64 provides a horizontal convergence correction of the outer electron beams to compensate for charges in focus voltage. This structure is described in U.S. Pat. No. 4,520,292 issued to van Hekken et al. on May 28, 1985, which is incorporated by reference herein for the purpose of disclosure. The separate portions 20*a*, 20*b* and 20*c* of the screen grid electrode 20 can be individually positioned so that the apertures 62 in the screen grid electrode 20 are aligned with the corresponding apertures 60 in the control grid electrode 18**.

In U.S. Pat. Nos. 4,298,818 and 4,500,808 the control and screen grid electrodes are brazed directly to the metallized patterns on the ceramic surfaces. The brazing of a plurality of formed metal parts tends to distort at least some of the parts and introduce stress into the ceramic member. If the stress is sufficiently great, the ceramic member will crack, rendering the cathode-grid assembly unusable.

U.S. patent application, Ser. No. 735,261 filed on May 17, 1985 by McCandless and assigned to the assignee of the present invention, discloses a substantially flat, bimetal transition member which is brazed to the metallized pattern on the ceramic member. The control and screen grid electrodes are then welded to the transition member. The thickness of the transition member is limited to about 20% of the thickness of the ceramic member so that minimal stress is introduced into the ceramic member during brazing. The McCandless patent application is incorporated by reference herein for the purpose of disclosure.

A drawback of the grid structure described in the McCandless patent application is that the longitudinal spacing between the control grid electrode and the screen grid electrode is provided by accurately controlling the heights of the respective flange portions of the electrodes as well as the flatness of the ceramic member. This requires two precision tool-formed metal grid electrodes and a precisely formed ceramic member. The high cost of such precision parts is an additional drawback that is overcome by the present novel BFR assembly 12.

Figure 4:
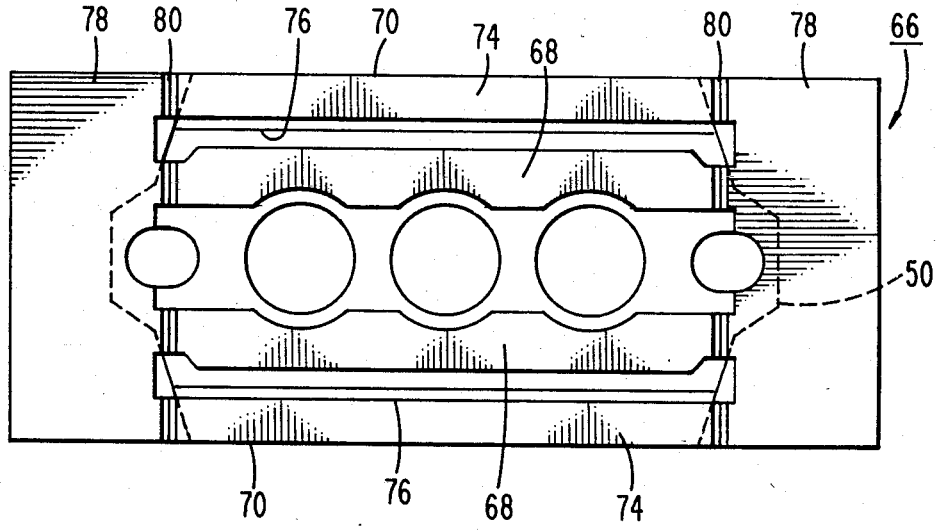
FIG. 4 is a plan view of a transition member used with the present invention.

As shown in FIGS. 3 and 4, a first transition member 66 having a substantially flat first part 68 and a second part 70, having an L-shaped cross-section, is brazed to metallized patterns **56*a* and 56*b* on the first major surface 52 simultaneously with the brazing of a second transition member 72 to the metallizing pattern 56*c* on the second major surface 54. The second part 70 of the first transition member 66 has a substantially flat first portion 74 in contact with the metallized pattern 56*b*, and a pair of upright portions 76 which are substantially perpendicular to the flat portion 74. The first part 68 and the second part 70 of the first transition member 66, and the second transition member 72 each include a break-away frame similar to those described in the above-referenced U.S. patent application, Ser. No. 735,261. As shown in FIG. 4, the first transition member 66 includes frame portions 78 which are connected to the first and second parts 68 and 70 by V-notched bridge regions 80. Breaking away the frame portions 78 of the first transition member 66 at the bridge regions 80 electrically isolates the first part 68 and the second part 70. The second part 70 of the first transition member 66 extends along both sides of the first major surface 52 of the ceramic member 50 so that the screen grid electrode 20 can be disposed between the substantially parallel upright portions 76. The control grid electrode 18 is welded to the first part 68 of the first transition member 66. The height of the upright portions 76 of the first transition member 66 is sufficient to permit longitudinal variations in the locations of the screen grid (G2) electrode portions 20*a*, 20*b* and 20*c* to accommodate variations in the height of the control grid (G1) 18, or irregularities in the flatness of the ceramic member 50. In other words, neither the ceramic member 50 nor the control grid (G1) electrode 18 is required to be a precision part since the plate-like screen grid (G2) electrode portions 20*a*, 20*b* and 20*c* can be longitudinally located by means of appropriate shims (not shown) and laterally positioned to provide the desired G1–G2 spacing and alignment between the successive electrodes. At least two L-shaped support members 81 are secured to each of the screen grid electrode portions 20*a*, 20*b* and 20*c*, one on each side. Each of the L-shaped support members 81 includes a screen grid electrode contact portion 82 and a transition member contact portion 84. The screen grid electrode contact portions 82 are attached to the plate-like portions 20*a*, 20*b* and 20*c* of the screen grid electrode 20. The portions 20*a*, 20*b* and 20*c* are disposed between the upright portions 76 of the first transition member 66. The width of the portions 20*a*, 20*b* and 20*c* is such that the portions are laterally positioned between the upright portions 76 so that the apertures 62 in the screen grid electrode portions 20*a*, 20*b* and 20*c* are aligned with the apertures 60 in the control grid electrode 18. The transition member contact portions 84 are welded to the upright portions 76 to secure the screen grid electrode portions 20***a*, 20*b* and 20*c* in alignment with the control grid electrode 18. The L-shaped support members 80 provide a floating support which more accurately locates and secures the screen grid electrode 20 than can be achieved by welding the screen grid electrode portions 20*a*, 20*b* and 20*c* directly to upright portions 76 of the first transition member 66.

In the present structure, the first and second transition members 66 and 72 comprise face-to-face laminated bimetal layers. The first transition member 66 comprises a first metal layer 90 formed from a nickel-iron alloy of 42% nickel and 58% iron. The first layer 90 has a thickness of about 0.2 mm (0.008 inches). A second metal layer 92 is preferably formed of copper and has a thickness of about 0.025 mm (0.001 inches). The melting point of the copper layer 92 is about 1033° C., and the melting point of the nickel-iron layer 90 is about 1427° C. The copper layer 92 is in contact with the metallized layers 56*a* and 56*b* on the first major surface 52. The second transition member 72 also comprises a face-to-face laminated bi-metal formed of a 0.2 mm thick nickel-iron layer 94 and a 0.025 mm thick copper layer 96 which is brazed directly to the metallized layer 56*c* on the second major surface 54. The BFR assembly 12 is attached to the electron gun 10 by welding the bead support members 15 to the flat portion 74 of the second part 70 of the first transition member 66. Longitudinal spacing between the screen grid (G2) electrode 20 and the first focusing (G3) electrode 22 is established by using a removable shim (not shown) to set the desired spacing during the welding of the bead support member 15 to the flat portion 74. If the previously described G1–G2 spacing varies beyond the optimum range for the electron gun 10, the placement of the bead support members 15 in the glass support rods 14 can be adjusted by embedding the support members 15 at a sufficient distance from the first focusing (G3) electrode 22 to provide the desired G2–G3 spacing. Alternatively, the ends of the bead support members 15 attached to the flat portion 74 may be bent to provide the proper G2–G3 spacing.

What is claimed is:

1. In a multibeam electron gun for a cathode-ray tube comprising a plurality of cathode assemblies and at least two spaced, successive electrodes having aligned apertures therethrough for passage of a plurality of electron beams, said cathode assemblies and said electrodes being individually held in position from a common ceramic member, said ceramic member having a first major surface and an oppositely disposed second major surface with a metallized pattern formed on at least a portion of each major surface, said electrodes being attached to said first major surface and said cathode assemblies being attached to said second major surface, wherein the improvement comprises a transition member attached to said metallized pattern on said first major surface of said ceramic member, said transition member including a substantially flat first part and a second part electrically isolated from said first part, said second part having a flat portion and two upright portions substantially perpendicular to said flat portion and substantially parallel to each other, one of the electrodes being attached to said first part of said transition member, and a plurality of support members being disposed between the other electrode and the upright portions of the second part of said transition members, whereby the other electrode can be positioned laterally and longitudinally with respect to the one electrode and secured in alignment therewith.

2. In an inline electron gun for a cathode-ray tube comprising three cathode assemblies and at least a control grid electrode and a screen grid electrode, each of said electrodes having three aligned apertures therethrough for passage of electron beams from said cathode assemblies, said cathode assemblies and said electrodes being individually held in position from a common ceramic member, said ceramic member having a first major surface and an oppositely disposed second major surface with a metallizing pattern formed on at least a portion of each major surface, said electrodes being attached to said first major surface and said cathode assemblies being attached to said second major surface, wherein the improvement comprises a transition member attached to said metallized pattern on said first major surface of said ceramic member, said transition member including a substantially flat first part and a second part electrically isolated from said first part, said second part having a flat portion and two upright portions substantially perpendicular to said flat portion and substantially parallel to each other, said control grid electrode being attached to said first part of said transition member, and a plurality of L-shaped support members attached at one end to said screen grid electrode, said screen grid electrode comprising at least one substantially flat plate disposed between said upright portions of said transition member, the other end of said L-shaped support members being adjacent to said upright portions of said transition member and attached thereto, whereby said screen grid electrode can be positioned laterally and longitudinally with respect to the control grid electrode and secured in alignment therewith.

3. In an inline electron gun for a cathode-ray tube comprising a modular beam forming region assembly and at least one main lens assembly attached to at least two insulative support rods, said beam forming region assembly including three cathode assemblies, a control grid electrode and a screen grid electrode, each of said electrodes having three aligned apertures therethrough for passage of electron beams from said cathode assemblies, said cathode assemblies and said electrodes being individually held in position from a common ceramic member, said ceramic member having a first major surface and an oppositely disposed second major surface with a metallizing pattern formed on at least a portion of each major surface, said control grid electrode and said screen grid electrode being attached to said first major surface and said cathode assemblies being attached to said second major surface, wherein the improvement comprises a bimetal transition member attached to said metallized pattern on said first major surface of said ceramic member, said transition member including a substantially flat first part and a second part electrically isolated from said first part, said second part having a flat portion and two upright portions substantially perpendicular to said flat portion and substantially parallel to each other, said control grid electrode being attached to said first part of said transition member, said screen grid electrode comprising three separate plate-like portions, each of said portions having one of said apertures therein, and a plurality of L-shaped support members interconnecting each of said plate-like portions of said screen grid electrode and said upright portions of said transition member, each of said L-shaped members including a screen grid electrode contact portion and a transition member contact portion, said screen grid electrode contact portions being attached to said plate-like portions of said screen grid electrode, said plate-like portions of said screen grid electrode being disposed between said upright portions of said transition member, said transition member contact portion of each of said support members being adjacent to said upright portions of said transition member and attached thereto, whereby said plate-like portions of said screen grid electrode can be positioned laterally and longitudinally with respect to said control grid electrode and secured in alignment therewith.

* * * * *